US010777173B1

(12) United States Patent
Skillings

(10) Patent No.: US 10,777,173 B1
(45) Date of Patent: Sep. 15, 2020

(54) MAGNETIC TOOL FOR INSTRUMENT SETUP

(71) Applicant: Small Stage LLC, Whitinsville, MA (US)

(72) Inventor: Stephen Skillings, Whitinsville, MA (US)

(73) Assignee: Small Stage LLC, Whitinsville, MA (US)

( * ) Notice: Subject to any disclaimer, the term of this patent is extended or adjusted under 35 U.S.C. 154(b) by 0 days.

(21) Appl. No.: 16/560,650

(22) Filed: Sep. 4, 2019

(51) Int. Cl.
*G10D 3/10* (2006.01)
*G10D 3/153* (2020.01)

(52) U.S. Cl.
CPC ..... *G10D 3/153* (2020.02); *G10D 3/10* (2013.01)

(58) Field of Classification Search
CPC ..... G10D 3/146; G10D 3/10
See application file for complete search history.

(56) References Cited

U.S. PATENT DOCUMENTS

2007/0193430 A1* 8/2007 Jang ..... G10D 3/006 84/313
2018/0025706 A1* 1/2018 Rognlien ..... G10D 3/006 84/458

* cited by examiner

*Primary Examiner* — Kimberly R Lockett
(74) *Attorney, Agent, or Firm* — Occhiuti & Rohlicek LLP

(57) ABSTRACT

A tool for use with a locking mechanism of an instrument setup of a stringed musical instrument comprises a body having a longitudinal axis, a transverse axis, a first surface extending along the longitudinal axis, and a second surface substantially parallel to the first surface of the body. The tool also includes a key disposed on the first surface and extending substantially along the transverse axis and a magnet disposed on the second surface of the body is configured for being received within a socketed head of the locking mechanism of the instrument setup system. The magnet is configured to be attached to a magnetic surface on the stringed instrument to hold the tool in place during use for "one handed" operation.

9 Claims, 5 Drawing Sheets

MAGNETIC TOOL FOR INSTRUMENT SETUP

Electric guitars have had vibrato systems mounted to them since early in the guitar's existence. These systems created a desirable vibrato effect that mimicked the sounds of a lap steel guitars. These systems are sometimes called "tremolo" systems, though their effect is not tremolo, a change in output amplitude, but vibrato, a change in frequency or pitch. These early systems created vibrato by changing the string tension using a rocking system. One of the problems with these early systems was tuning instability, where the guitar would go out of tune due to friction in the string's contact points on the guitar. For example, when the bar was depressed, the string would slacken, and the tension of the string would go down and the note would lower, but at some tension value, the string would "slip" on the guitar's nut and slacken the length of string between the nut and the tuning machine. Upon returning the vibrato bar to its original position, the tension between the nut and the tuning machine would not return to its prior value and thus, neither would the string over the fretboard, thus the guitar would be out of tune and unusable for music making. The same effect is true of raising the bar, tightening the strings, and returning the bar to its original position. Raising and lowering the bar, to create a more prominent vibrato effect, thus greatly increases the chance of the instrument being out of tune once returned to the original position.

In the late 1970's a company called Floyd Rose® created a "double locking" system which completely eliminated the problem. By clamping the string at two points, at the bridge and at the nut, a musician could use the vibrato system with great effect and the instrument would come back to perfect pitch. These "double locking" systems completely fixed the problem as long as the metal strings stayed stable. Slight changes to the tuning were often a problem with these systems do to instability in the temperature of the wire, perhaps due to stage lights or playing, or the change in the elastic deformation or plastic deformation of the metal used in making the string. These slight changes were remedied in the Floyd Rose® "double locking" system with the addition of "fine tuners" to the system. The fine tuners are made of a threaded rod with a knurled end to allow a musician to use their hand to make the fine adjustments. Because of a clever lever arm system, the force to turn the fine tuners does not require a wrench and can be easily turned by hand.

To lock the strings in place, the "double locking" system uses a hex screw to push on a platen toward a base. The string is inserted in a gap between the platen and the base, and the platen is moved toward the base by turning the hex screw, pinching the string between the platen and the base "locking" it in place. The forces required to close the locking platen to the base require considerable leverage and a tool is used, typically a standard 3 mm hex wrench.

As the strings are played they vibrate and as they are repeatedly strummed or struck with a pick or fingers, they are both stretched and slackened by the vibrato system, causing them to lengthen slightly. This lengthening of the strings is the motivation for "fine tuner" adjustments. However, over time, the fine tuner is turned until the length of the threads is exceeded. The only remedy to tune the strings to their appropriate pitch is to unlock the "nut" end of the "double locking" system with a hex wrench, reset the fine tuners to the middle of their thread range, use the instrument's standard tuning keys to bring the instrument to pitch and, then using the hex wrench, tighten the nut down on the string, "locking" it in place.

Given that a musician may perform under hot lights, or outside, where temperatures are changing during their performance, there is sometimes a need to make fine tuner adjustments between songs. At some performances, there may be a need to go beyond find tuner only adjustments and reset the tuning using the method of unlocking the nut. Having the hex tool nearby is an important capability in this situation.

Today there is a product that allows musicians to mount a hex tool holding device to their guitar, but requires screws be driven into the guitar, which is something many musicians try to avoid and thus, it is not a popular solution, especially with professional musicians. Also, this mounting device is only effective if you mount it to every guitar you own, one per guitar, and is not readily transferrable without a drill, a drill bit, a drilling template, a depth guide, and a screwdriver. For some instruments with a double locking system, especially those with a "3 per side" headstock, there is not enough room on the back of the instrument to mount the system and fit the hex wrenches making it ineffective for use for some guitars.

SUMMARY

A general aspect of the invention relates to a tool for use with a locking mechanism of an instruments setup of a stringed musical instrument. The tool comprises a body having a longitudinal axis, a transverse axis, a first surface extending along the longitudinal axis, and a second surface substantially parallel to the first surface of the body. The tool also includes a key disposed on the first surface and extending substantially along the transverse axis and a magnet disposed on the second surface of the body and configured to be attached to a magnetic surface on the stringed instrument. The key is configured for being received within a socketed head of the locking mechanism of the vibrato system.

Embodiments of this aspect of the invention may include one or more of the following features.

The key is hexagonal in cross section to be received within a hexagonal socketed head. The body is formed of a polymer and has a substantially rectangularly prismatic shape. The body includes end regions spanned by a central region, the end regions having a first thickness greater than a second thickness of the central region. The end regions are rounded.

The magnet is disposed in the central region and substantially hallway along the longitudinal axis. The magnet comprises a neodymium alloy.

Among other advantages, the instrument setup tool allows a musician to quickly and effectively access a tool from their instrument during performance. This invention results in an instrument setup tool (e.g., hex wrench) that is securely stowed and hidden from view, away from the areas where the musician plays the instrument, and without requiring holes to be drilled in the instrument.

DESCRIPTION

Figure 1:
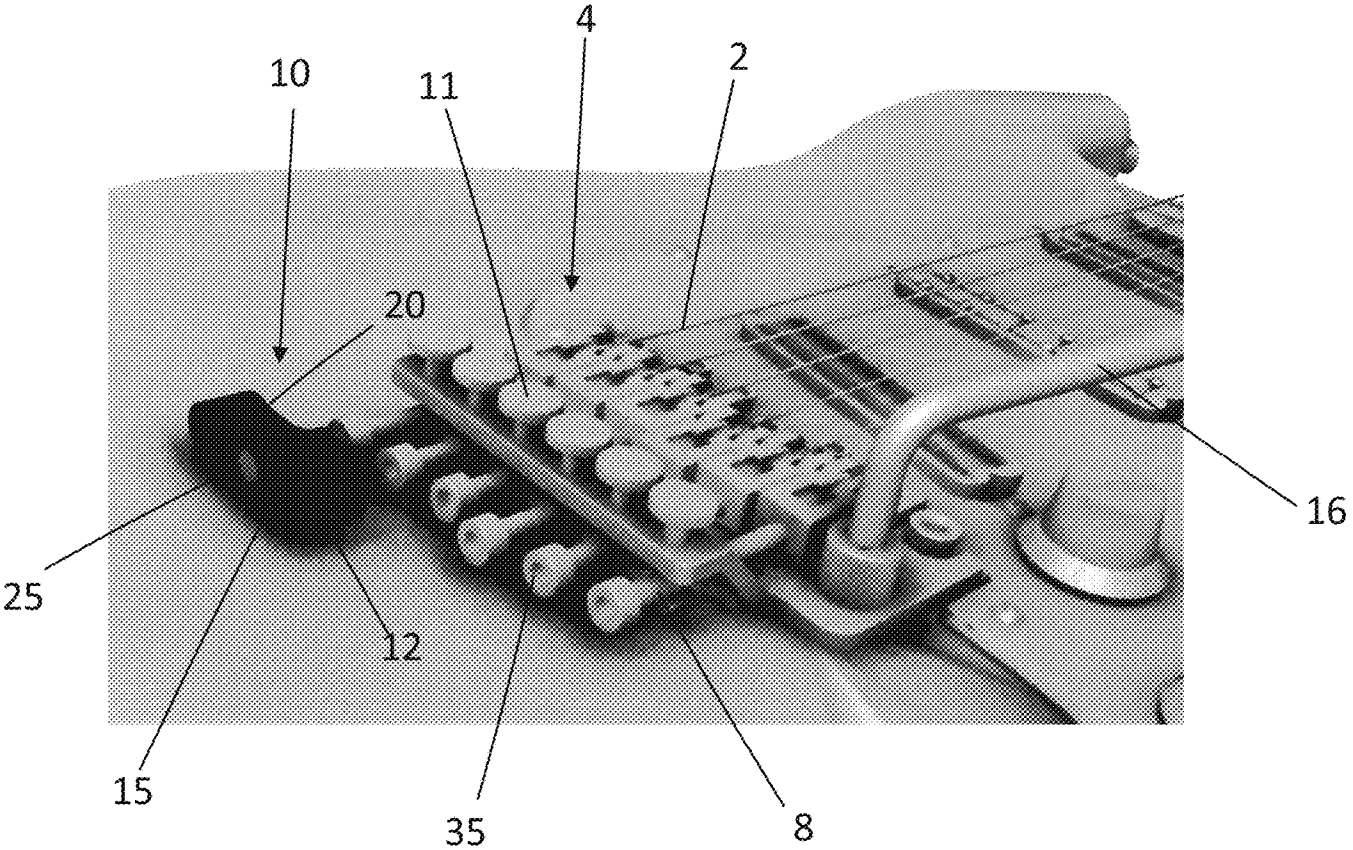
FIG. 1 is a view of the hex wrench being used to tighten hex screws on the body of a guitar for a double-locking vibrato system.
Figure 2:
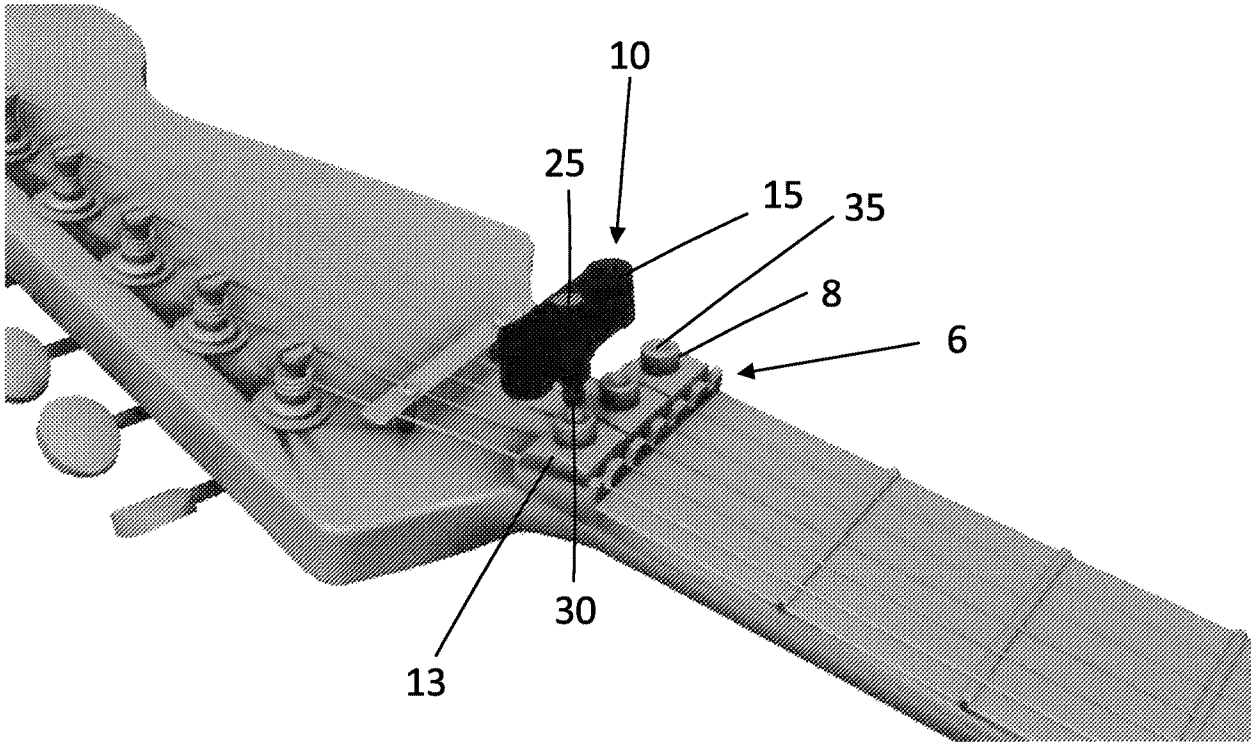
FIG. 2 is a view of the hex wrench being used to tighten hex screws on the neck of a guitar for the double locking vibrato system

Referring to FIGS. 1 and 2, a double-locking vibrato system as manufactured by Floyd Rose allows you to lock the strings 2 on your guitar in place at two points, at the bridge 4 itself, and at the locking nut 6. The bridge 4 features locking saddles 7, which the strings 2 are inserted into and locked into place by tightening bolts 8 on the back of the bridge with a hex wrench 10. The bridge features fine tuners 11, one for each string 2. This configuration allows players to adjust their tuning if strings 2 sharpen or flatten from extensive use or temperature changes.

The locking nut 6, shown in FIG. 2, is used in place of a traditional bone or synthetic nut, has a similar locking design whereby three plates 13 lock down two strings 2 each. These are also tightened with a hex wrench 10, preventing the strings from sliding over the nut and going out of tune when using a whammy bar 16.

Figure 3:
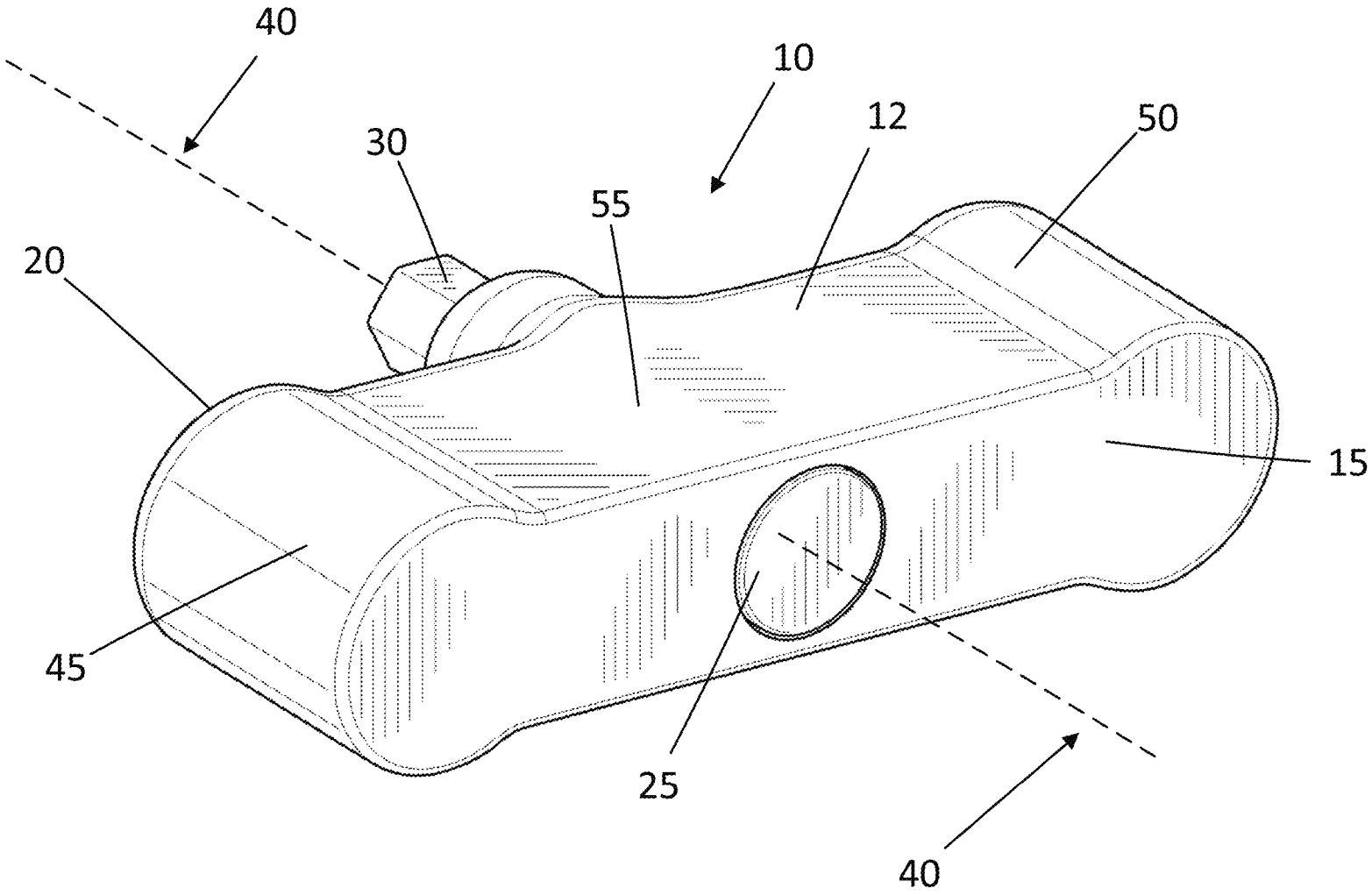
FIG. 3 is a view of the hex wrench showing the positioning of the embedded magnet.
Figure 4:
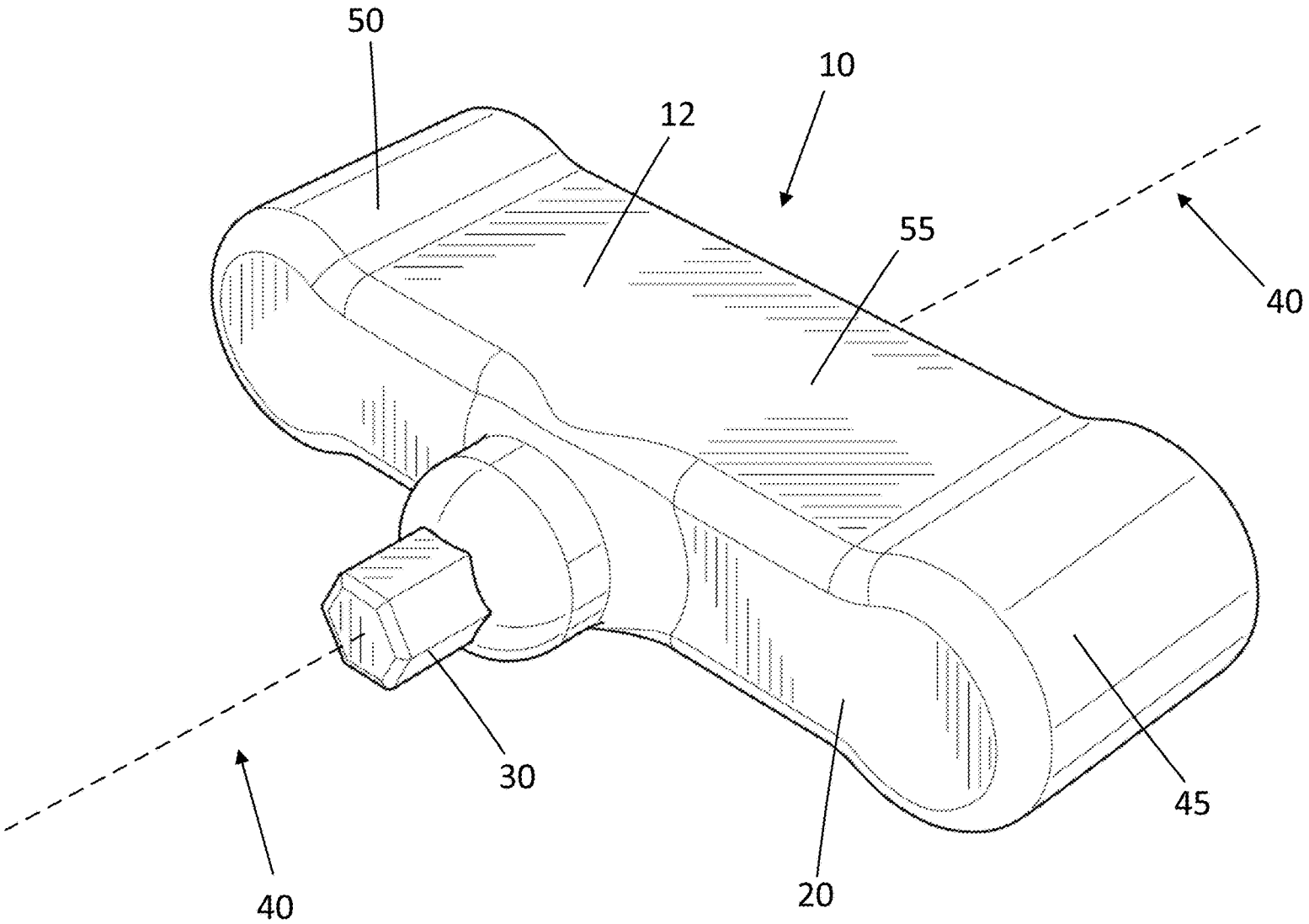
FIG. 4 shows a view of the hex wrench showing the male hexagonal member.

Referring to FIGS. 3 and 4, in a particular embodiment of the invention, the hex wrench 10 comprises a flattened handle 12 with a roughly rectangular-prismatic shape, with a top side 15 and a bottom side 20. Handle 12 is typically formed of a non-metallic polymeric material (e.g., plastic). Embedded in the top side 15 is a magnet 25, and projecting from the bottom side 20 is a male hexagonal member 30 that inserts into and fits snugly in female hexagonal screw-heads 35 on the tightening bolts 8. The female hexagonal screw-heads 35 are configured so that when torque is applied to the male hexagonal member 30 the tightening bolts 8 will turn, resulting in tightening or loosening of the locking plates 13, locking the string tension or freeing the string to move during the tensioning of the string during tuning.

As shown in FIGS. 3 and 4, in this embodiment, the magnet 25 is centrally disposed on the top side 15 of the handle 12 and the male hexagonal member 30 is centrally disposed on the bottom side 20 of the handle 12 perpendicular to the plane of the bottom side 20 of the handle 12. The handle 12 has a proximal side 45 that is rounded and a mirror image distal side 50 that is similarly rounded. The rounded proximal side 45 and distal side 50 facilitate gripping the handle 12 by hand. Spanning the proximal side 45 and the distal side 50 are flattened surfaces 55. The rounded proximal side 45 and rounded distal side 50 spanned by flattened surface 55 form a configuration in which the handle thickness is greater at the ends than in the middle region between those ends. When the hexagonal member 30 is inserted into a female hexagonal screw-head 35, and the handle 12 is gripped by hand and turned about the axis 40, this results in torque being applied to the tightening bolts 8.

Figure 5:
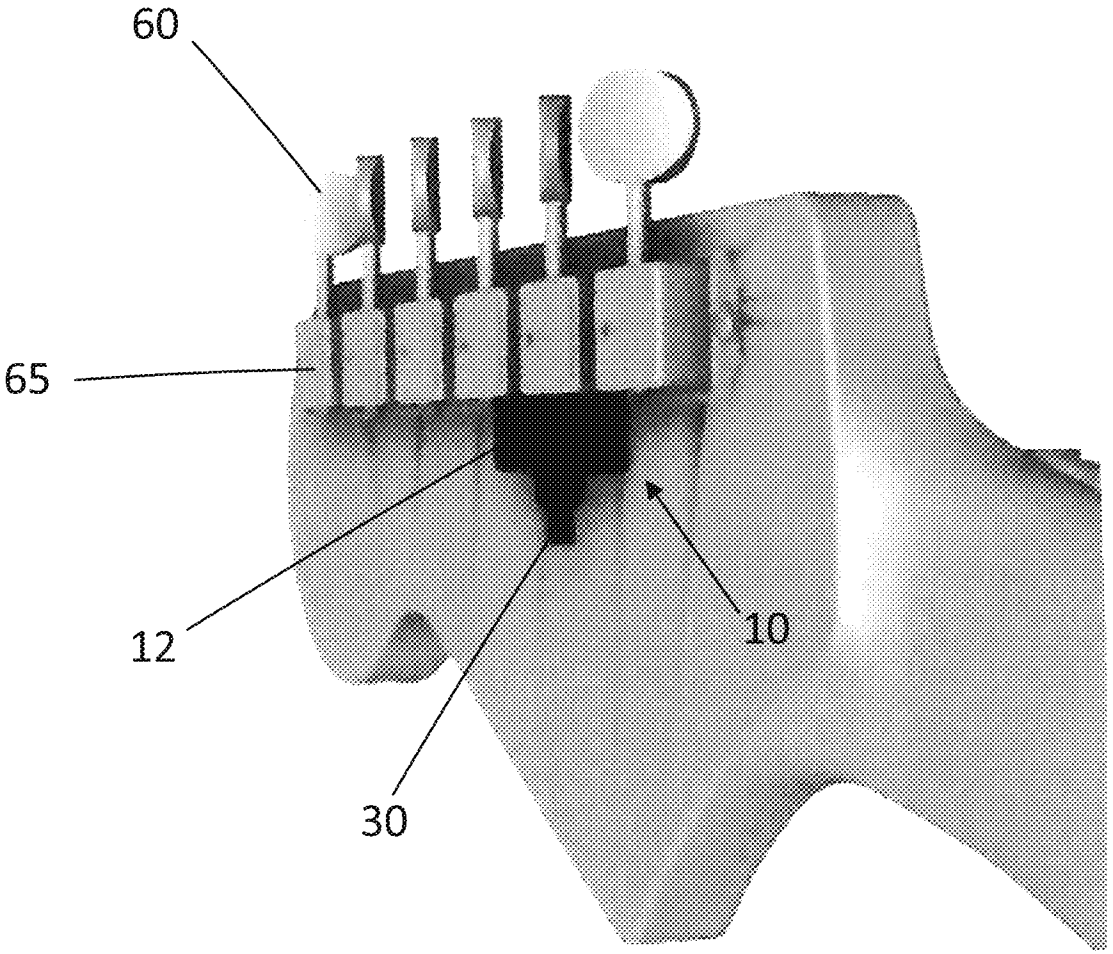
FIG. 5 shows a view of the hex wrench when not in use, magnetically attached to the guitar "tuners" or "tuning machines."

As shown in FIG. 5, the hex wrench 10 unobtrusively tucks away under tuning machines 60 at the neck of a guitar or similar stringed instrument and is held in place by the magnets 25 that are in contact with metal casings 65 of the tuning machines.

It will be appreciated that a handle 12 for which the proximal side 45 and the distal side 50 have bulbous ends will facilitate a good "thumb hold" on the end. Similarly, a handle 12 that is smooth on each end will facilitate wider surface area of pressure, minimizing pressure points on the user's hand. It will likewise be appreciated that a plurality of differently shaped handles 12 may be optimized for each brand, type and style of instruments including, but not limited to, guitar and bass.

As shown in FIG. 2, the hex wrench 10 is used with a metal bolt 8. It is helpful to the musician if, when standing and tuning, as when on stage, the hex wrench 10 does not fall from the guitar. Therefore, the magnet 25 and hex shaft 30 are assembled in a way that the magnet 25 transfers magnetism through the hex shaft 30 so that when the hex wrench 10 is inserted into the screw-head 35 it is attracted magnetically to the bolt 8 and the hex wrench 10 will not fall out of the screw-head 35 due to the force of gravity, and in many embodiments with strong magnets, due to many kinds of hits or bumps that might happen accidentally on stage. The magnetic force is transferred best when the hex shaft 30 is touching the magnet 25 in assembly, but some gap can be present and still transfer effective magnetic force to retain the hex wrench 10 in the bolt 8 effectively for a musician on stage. This allows for "one hand" operation of the hex wrench 10 on stage which is helpful with speed and convenience when making this adjustment at a performance.

Embodiments may include a plurality of magnets 25 embedded in the top side and a plurality of male hexagonal members 30 projecting from the bottom side. Two or more magnets 25 may for example be set at a spacing that maximizes the effective holding power of the magnets 25 to a particular instrument's metal tuning machine casings 65. Multiple hexagonal members 30 will provide flexibility for different sized screw-heads 35 on the same instrument, and/or for hexagonal members 30 with different lengths. Hexagonal members 30 may be made shorter or longer in order to obtain a desired balance of effectiveness against taking up less space on the instrument.

Hexagonal members 30 may comprise one or more of a 3 mm hex shaft, a 2 mm hex shaft, or a ⅛" hex shaft, or any hex shaft size that is appropriate for a particular instrument. In other embodiments, hexagonal members 30 may be replaced by one or more tools such as, but not limited to, a Phillips (i.e., "cross-recess") screw driver, a flat head screw driver, a hexagonal socket, a square shaft, a Torx (i.e., star) shaft, etc., or any other type of tool end that may be used for tuning or modifying instruments today, or in the future.

Embodiments may be optimized for guitars that do not have a "double locking" system but are created with tool types that are useful for some musicians to have handy on their guitar like saddle set screws and truss rod adjusters. These embodiments might include a foldable section of the invention to allow for longer tool shafts that do not protrude from the back of the guitar and are more streamlined when not in use.

It is apparent that the structural features of the invention can be obtained by a variety of materials and construction methods. In order to obtain a light-weight hex wrench 10, the holder can be constructed of a durable plastic. The hexagonal member 30 may be constructed of any suitable metallic alloy, or of high strength polymer materials. The magnet 25 may be an ordinary refrigerator magnet, or, preferentially, a rare-earth "super" magnet constructed using a neodymium alloy or other alloy incorporating rare earth metals.

It is to be understood that the foregoing description is intended to illustrate and not to limit the scope of the invention, which is defined by the scope of the appended claims. Other embodiments are within the scope of the following claims.

What is claimed is:

1. An apparatus for use with a locking mechanism of an instrument setup of a stringed musical instrument, the tool comprising:

a body having:

a longitudinal axis, a transverse axis transverse to the longitudinal axis, a first surface extending along the longitudinal axis, and a second surface substantially parallel to the first surface of the body;

a member disposed on the first surface and extending substantially along the transverse axis, the member configured for being received within a socketed head of the locking mechanism of the instrument setup system;

a magnet disposed on the second surface of the body and configured to be attached to a magnetic surface on the stringed instrument; and wherein the body has a substantially rectangularly prismatic shape and includes end regions spanned by a central region, the end regions having a first thickness greater than a second thickness of the central region.

2. The tool apparatus of claim 1 wherein the member is hexagonal in cross section to be received within a hexagonal socketed head.

3. The tool apparatus of claim 1 wherein the body is formed of a polymer.

4. The tool apparatus of claim 1 wherein the end regions are rounded.

5. The tool apparatus of claim 4 wherein the magnet is disposed in the central region and substantially hallway along the longitudinal axis.

6. The tool apparatus of claim 1 wherein the magnet comprises a neodymium alloy.

7. The apparatus of claim 1 wherein the member is a male hexagonal member.

8. The apparatus of claim 7 wherein the male hexagonal member includes a hex shaft.

9. The apparatus of claim 1 wherein the magnet transfers magnetism to through the member to the socketed head of the locking mechanism of the instrument setup system.

* * * * *